US006659892B2

(12) United States Patent
Lytle et al.

(10) Patent No.: US 6,659,892 B2
(45) Date of Patent: Dec. 9, 2003

(54) KICKBACK TRAINING GOAL

(76) Inventors: Thomas William Lytle, 76718 California Dr., Palm Desert, CA (US) 92211; Fred Saldana, 609 Marguerita, Corona del Mar, CA (US) 92625-2338

( * ) Notice: Subject to any disclaimer, the term of this patent is extended or adjusted under 35 U.S.C. 154(b) by 0 days.

(21) Appl. No.: 10/036,017

(22) Filed: Dec. 21, 2001

(65) Prior Publication Data

US 2003/0119611 A1 Jun. 26, 2003

(51) Int. Cl.[7] ..... A63B 69/00; A63B 67/00; A63B 63/00

(52) U.S. Cl. ..... 473/434; 273/402; 473/471

(58) Field of Search ..... 273/348, 400, 273/407, 410, 401, 402; 473/197, 492, 415, 422, 421, 439, 446, 449, 469–471, 476, 478, 489, FOR 116, 118, 128, 434, 435; D21/705

(56) References Cited

U.S. PATENT DOCUMENTS 1,540,670 A * 6/1925 Vidmer ..... 473/190
4,286,786 A 9/1981 Papadopoulos
4,407,507 A 10/1983 Caruso et al.
4,420,158 A 12/1983 Klock et al.
4,702,478 A * 10/1987 Kruse ..... 273/127 B
4,703,931 A * 11/1987 Steen ..... 473/435
4,723,780 A * 2/1988 Vinzetta ..... 473/197
4,786,053 A 11/1988 Barnes, Jr.
4,905,996 A 3/1990 Tallent et al.
4,913,428 A 4/1990 Nauman
5,048,844 A 9/1991 Haseltine
D320,637 S 10/1991 Fish, Jr. et al.
5,080,375 A 1/1992 Moosavi
5,308,083 A 5/1994 Grunfeld et al.
D358,184 S 5/1995 Amburgey et al.
5,496,040 A * 3/1996 Amburgey et al. ..... 473/478
5,577,721 A * 11/1996 Hardee et al. ..... 473/421
5,833,557 A * 11/1998 Cole ..... 473/472
5,839,733 A * 11/1998 Meeks et al. ..... 273/400

* cited by examiner

*Primary Examiner*—Sabastiano Passaniti
*Assistant Examiner*—Mitra Aryanpour
(74) *Attorney, Agent, or Firm*—Gene Scott-Patent Law & Venture Group

(57) ABSTRACT

A practice goal apparatus comprises a box-like structure having an open face and providing plural interior faces adapted to rebound a resilient ball upon impact. The plural interior faces are set at selected angles such that the resilient ball, upon forcefully entering the box-like structure through the open face, from any direction will rebound in a manner resulting in forceful exit from the box-like structure back to the kicker. The apparatus has a hollow base that may be filled with water or sand to anchor it in place.

3 Claims, 3 Drawing Sheets

KICKBACK TRAINING GOAL

BACKGROUND OF THE INVENTION

1. Field of the Invention

This invention relates generally to field goal equipment and more particularly to a field goal for use in soccer or hockey practice and having the unique capacity to return the ball to the kicker no matter the angle at which the ball enters the goal.

2. Description of Related Art

The following art defines the present state of this field:

Papadopoulos, U.S. Pat. No. 4,286,786 describes a soccer training goal comprising, a goal frame with a net connected thereto which defines a goal space with a goal opening. An inclined plate is connected to the goal frame at the bottom of the goal space and is inclined downwardly toward the goal opening, whereby a soccer ball kicked into the goal space will initially be retained within the goal space by hitting the net, whereby the net absorbs the impact of the ball and then rolls out of the goal back to the practicing kicker. An adjustment device may be connected between the inclined plate and the goal frame to allow for the variation of the incline on the inclined plate to vary the speed at which the soccer ball leaves the goal space. The inclined plate may further be positioned vertically and provided with markings such as for example, numbers 1 to 10 to act as a soccer ball target to be utilized in accuracy shooting practice. The soccer-training goal may be collapsible to allow for its portability and include a field sight, a counting device and a target, which can be utilized for accuracy shooting in conjunction with the inclined plate. A triangular block is positioned on the plate to deflect the soccer ball away from the target as it rolls down the plate.

Caruso et al., U.S. Pat. No. 4,407,507 describes a portable soccer goal having a pair of stationary posts, and a pair of leg braces pivoted to the upper ends of the posts, one brace for each post. The upper ends of the posts are connected by removably connected cross pieces defining the upper boundary of the goal. A net wrapped about the posts and braces and supported on the top of the posts is also provided such that the mouth of the goal is defined between the leg braces. Shoes are provided for the bottom of the posts and braces, each shoe having a spike for insertion into the ground to erect the goal. The cross pieces are connected by snap buttons and arcuate slots so that the posts may be rotated relative to the crosspieces.

Klock et al, U.S. Pat. No. 4,420,158 describes a portable sports field goal assembly and framework including an elongated net with a peripheral rope frame that may be secured to portable end frames. The end frames are made up of at least two releasably interconnected support members that can be secured in upright positions along the ground surface by ground cup assemblies and by guy cord assemblies. Lengths of the rope frame may extend through openings along the support assemblies. The rope lengths are knotted to secure the net corners to the frames. The ground cup assemblies each include an upwardly open cup with a central opening in its bottom horizontal wall. The openings receive headed spikes that may be driven into the ground to secure the cup against the ground surface. The cups also include access openings that receive lengths of the rope frame to be looped over the headed ends of the spikes. The rope frame can thereby be secured by the spikes to the ground and the supporting general framework.

Barnes, Jr., U.S. Pat. No. 4,786,053 describes an apparatus readily useful for setting up to play a plurality of water and yard or court games. The construction comprises a plurality of tubing sections, preferably made of polyvinyl chloride. The parts can be glued together in large part so that only one or two pieces need to be changed out to set up for different games or sports. The tubing permits the use of water as the ballasting medium, which is readily available and disposable in most situations.

Tallent et al., U.S. Pat. No. 4,905,996 describes a ball and target net game apparatus wherein a target net includes a perimeter framework securing a generally planar net wherein the frame work includes a plurality of forwardly extending horizontal legs and associated bracing to maintain the netting in a secure arrangement in use. The framework and the legs of the apparatus are telescoping to effect a compact structure easily stored when not in use. An inner net is selectively securable to spaced elongate straps longitudinally secured relative to the main net portion of the apparatus to provide a target in variable orientation relative to the main net.

Nauman, U.S. Pat. No. 4,913,428 describes a portable self-supporting post assembly designed for supporting sports nets, tarpaulins, awnings and the like includes a post anchor with downwardly extending prongs adapted to be imbedded in a penetrable support surface such as sand or soil. The pongs are fastened to a base plate of the post anchor at locations displaced outwardly from a post or pole which extends upwardly from a top surface of the base plate. The prongs are formed of flat spring metal and are outwardly curved to enhance their gripping action in the support surface. The resiliency of the prongs maintains the tautness of a net, tarpaulin, awning or the like which is supported between a pair of the post assemblies.

Haseltine, U.S. Pat. No. 5,048,844 describes a soccer goal practice device having a frame and a net extending within the frame. The frame has first and second upstanding side members and a cross member extending between, and connected to the top ends of, the side members. The net is formed as a lattice having a perimeter corresponding substantially in shape and size to the frame. The net includes a rugged perimeter cord along the perimeter of the net, and the perimeter cord has a length shorter than that of the perimeter of the net. The perimeter cord is fastened to the frame such that the net extends between the side members and the cross member. Due to the reduced perimeter of the perimeter cord, the net will include a slight blouse when extending over the frame. This blouse causes ground balls entering the net to be rebounded with an upward velocity component, such that rebounded ground balls bounce.

This provides a more challenging and realistic return of the ball to the user. The frame is modular such that the entire device may be easily assembled, disassembled and transported.

Moosavi, U.S. Pat. No. 5,080,375 describes a soccer goal assembly adjustable in size and shape to accommodate playing areas of limited to full sizes, indoors or outdoors, full or partial teams, and children or adult players. The goal assembly has a framework covered by a ball stopping net. Individual frame members can be selected or assembled in selective lengths for the desired goal sizes.

Gruhfeld, U.S. Pat. No. 5,308,083 describes a portable soccer goal with rebounding net to return a ball struck into the net. The frame of the goal is formed by a pair of vertical posts and a long horizontal tube and is secured to the ground by a pair of base supports. Pivotable struts further support the vertical posts. The net has a sleeve that positively joins the net to the frame over the entire horizontal length of the frame, and there is a resilient mainstay cord threaded into the net near the periphery. The net and mainstay cord are secured by hooks at the base supports, and the net is oriented to the outside of the struts. When the struts are spread outwards, the tension in the net is increased so as to be sufficient to rebound a ball struck into the net.

Amburgey, U.S. Pat. No. Des. 358,184 describes a toy basketball goal design.

Fish, Jr., U.S. Pat. No. Des. 320,637 describes a folding soccer and hockey goal design.

The prior art teaches the use of field goal equipment but does not teach such a goal with the ability to return the ball to the player due to the angles set into the several portions of the structure. The present invention fulfills these needs and provides further related advantages as described in the following summary.

SUMMARY OF THE INVENTION

The present invention teaches certain benefits in construction and use which give rise to the objectives described below.

A practice goal apparatus comprises a box-like structure having an open face and providing plural interior faces adapted to rebound a ball, puck, etc., upon impact. The plural interior faces are set at selected angles such that the ball or puck, upon forcefully entering the box-like structure through the open face, from any direction will rebound in a manner resulting in forceful exit from the box-like structure back to the kicker or skater. The apparatus has a hollow base that may be filled with water or sand to anchor it in place.

The apparatus may be made so as to be easy to assemble or disassemble. It is useful for both indoor and outdoor playing areas, by one or more players. It is an object of the present invention to provide a target goal that provides four target areas as nets supported by a framework.

The framework consists of four vertical posts, three top horizontal rails and one front horizontal crossbar, and three bottom horizontal rails. The later three rails become solid base supports when filled with water or sand. All framework parts are made of hardened white plastic. The goal has a center net, two side nets, and a top net. These nets use adjustable straps to control the speed of return of ball or puck. Preferably, the target nets are made with four inch borders in neon colors with white mesh netting.

The design of this target goal works as a cage that stops shots, returns passes, and works a give-and go pass. Low passes or shots will rebound around the goal, sending shots back to the player.

Emerging at a time when space is at a premium, using a short field, fewer players, with or without the use of a goalkeeper, this target goal benefits the recreational and club player for his or her practice. To maximize the efficiency of practice drills, it is desirable for a player to be able to take shots into the goal that simulate a traditional goal. The shots rebound so the player may take a series of rapid fire shots on the goal. Furthermore, a player's ability to control the rebounding shot enhances his/her game skills. The structure is preferably strong enough to absorb a players power shots.

A further object is to provide a training goal that a player can use to improve accuracy and efficiency in taking shots and passing, plus providing the ability to control passes that are high, low, fast, slow, or bouncing. Along with increase player stamina, these elements can only produce a better player.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above described drawing figures illustrate the invention in at least one of its preferred embodiments, which is further defined in detail in the following description.

Figure 1:
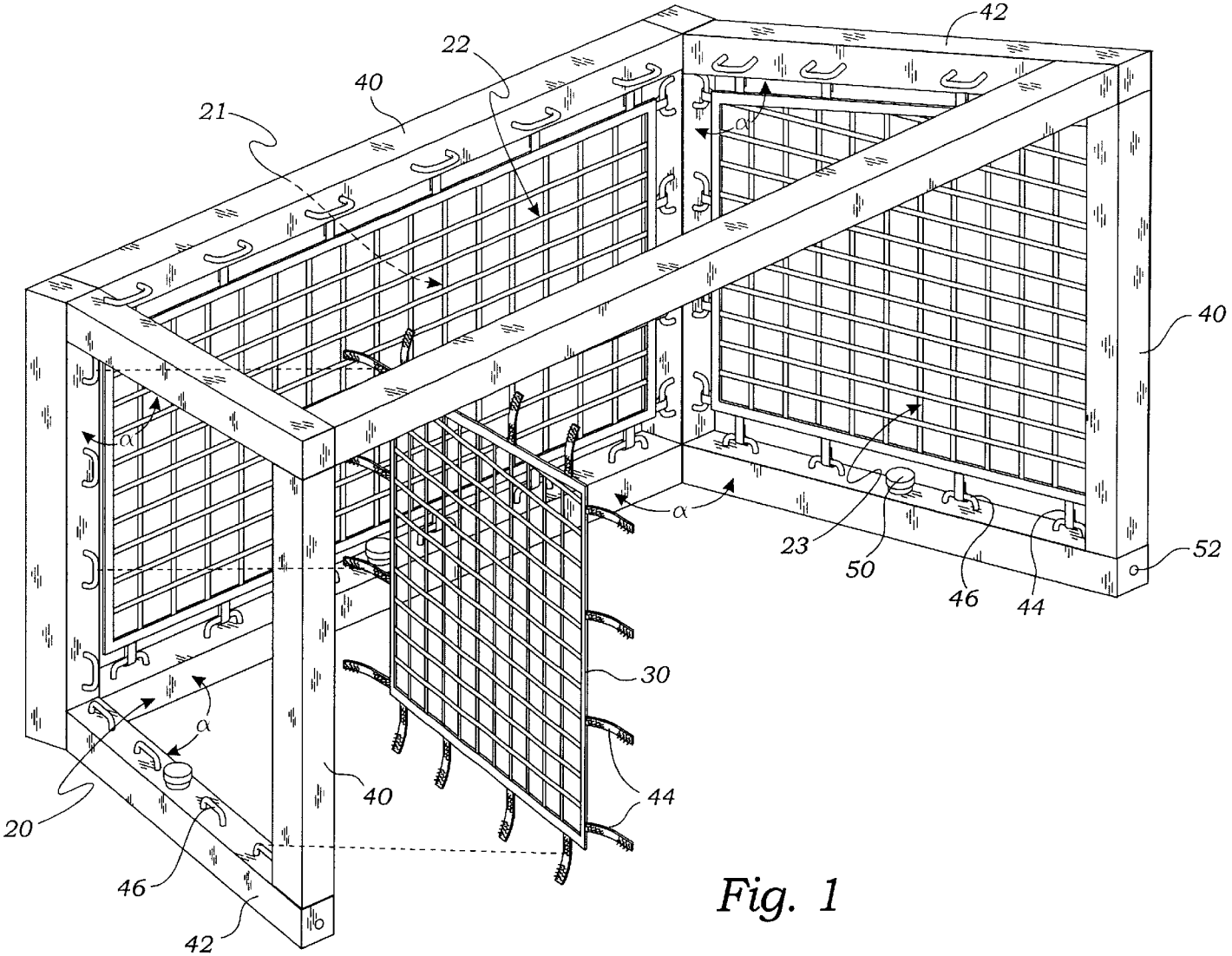
FIG. 1 is a perspective view of the preferred embodiment of the invention showing how the netting screens of the invention are attached.
Figure 2:
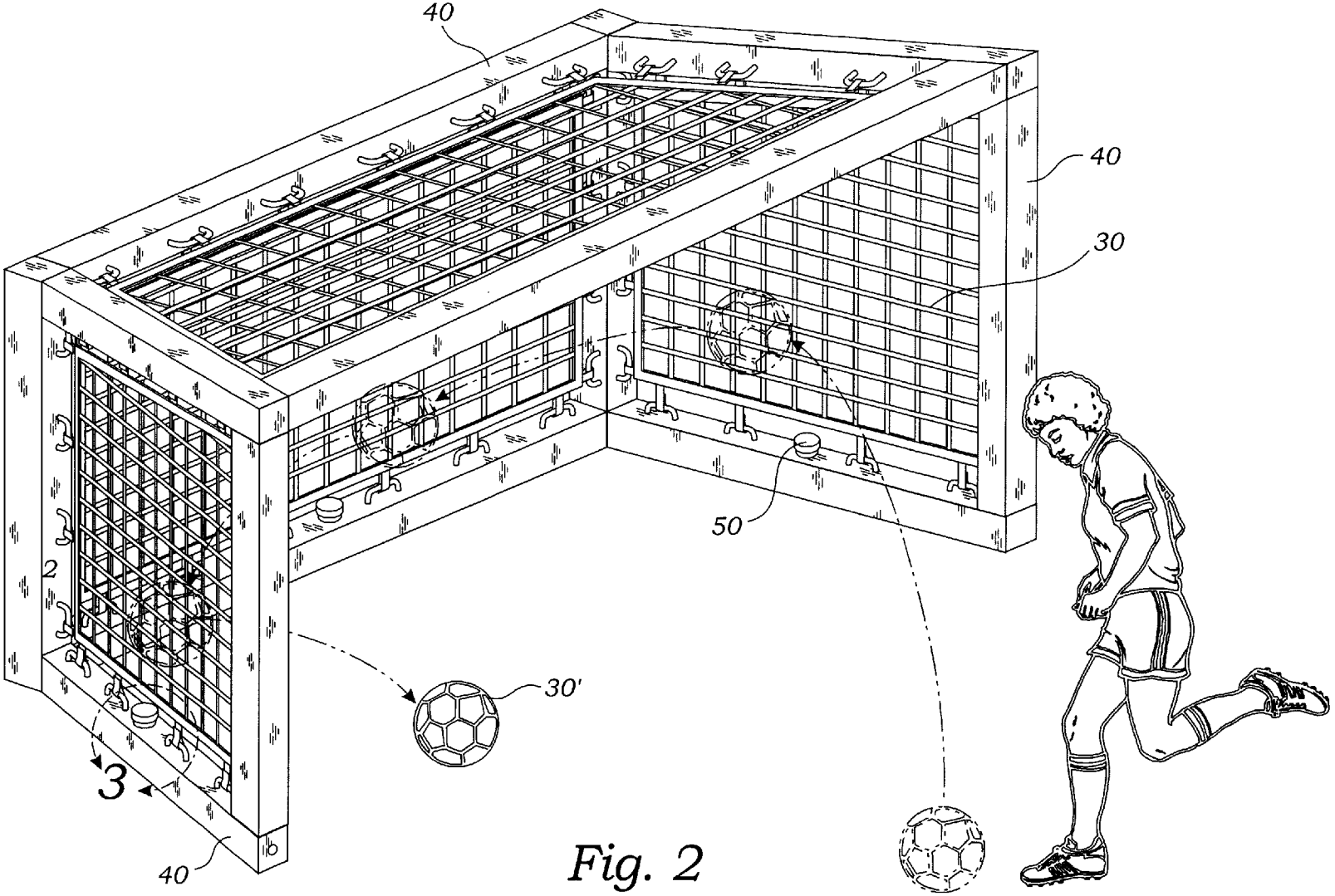
FIG. 2 is similar to FIG. 1 showing the invention in use.
Figure 3:
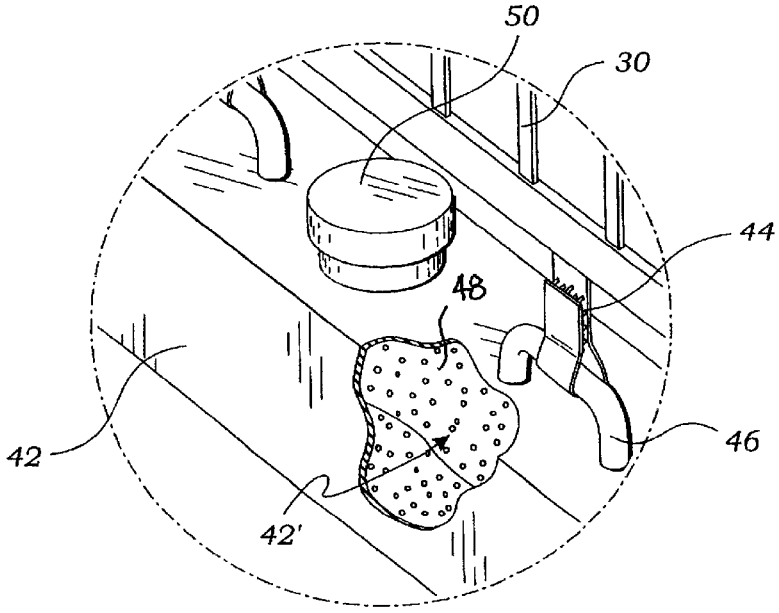
FIG. 3 is a partial enlarged portion with breakaway, taken from line 3 in FIG. 2.
Figure 4:
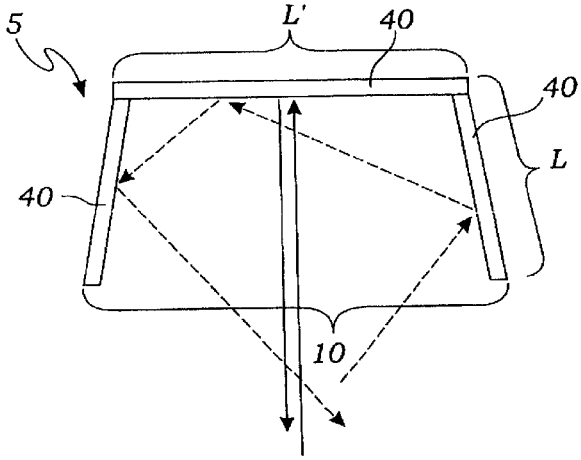
FIG. 4 is a schematic plan view thereof illustrating the motion of a ball within the invention as it moves between side and rear rebounding surfaces.
Figure 5:
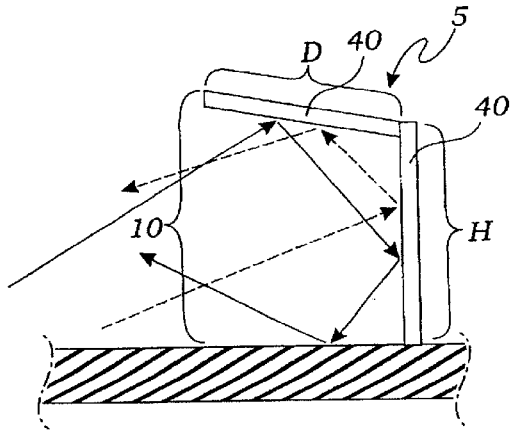
FIG. 5 is a further schematic, a side view thereof; illustrating the motion of a ball within the invention as it moves between top, back and ground surfaces.

The present invention is a practice goal apparatus having a box-like structure 5 with an open face 10 (FIGS. 4 and 5). The box-like structure provides plural interior faces 20–23 adapted for rebounding a resilient ball 30', or a hockey puck or other sports workpiece, upon impact therewith. The plural interior faces 20–23 are set at selected angles $\alpha$ relative to each other such that the resilient ball 30', upon forcefully entering the box-like structure 5 through the open face 10, from any direction relative thereto, is rebounded in a manner resulting in a forceful exit from the box-like structure 5 as best seen in the schematics: FIG. 4 and FIG. 5.

To accomplish this, the interior faces 20–23 each provide resilient planar surfaces. The plural interior faces 20–23 comprise a rear face 21, a pair of spaced apart side faces 20, 23 and a top face 22. With respect to the rear face 21, the top face 22 and both of the side faces 20, 23 form an included angle $\alpha$ of between 100 and 110 angular degrees, with an ideal angle of approximately 105 degrees. It has been discovered that these particular angles result in the surprising ability of the apparatus to return a ball 30' or puck back out of the apparatus and toward the approximate location from which it started its entry, and with a high probability, so as to facilitate kicking or shooting practice. The angular range 100 to 110 degrees improves ball return over other angles by a factor of 2–5. Several typical ball movements are shown in FIGS. 4 and 5. In order to accomplish this ball return capability, the length "L" of each of the side faces 20, 23 is in the preferred ratio of 5/8 with respect to the length "L" of the rear face 21. See FIG. 4. A selection from a ratio range of between 1/2 and 3/4 will also provide adequate ball return. This same ratio range is applicable to the depth "D" of the top face 22 with respect to the height "H" of the rear face 21. These ratios are approximately shown in FIGS. 4 and 5. The orthogonally constructed prior art goals that are well known and in common use do not facilitate such improved ball return.

Preferably, each of the plural interior faces 20–23 is comprised of a taught flexible netting 30 held within a rectangular structural frame 40. Such a frame structure 40 is made of bars 42 of plastic, metal or wood, and are joined by any of the well known methods including the use of common hardware fasteners. The netting 30 is fastened to the bars 42 by strap 44 and U-bar 46 construction, as shown, or similar fastening methods. Such straps 44 may be held by VELCRO® type surface-to-surface attachments, as shown, so that the level of tightness is adjustable. In this manner it is possible to adjust the rebounding speed of a ball 30' or puck that contacts the netting 30. Preferably, at least one of the bars 42 includes a means for weighting 48, so as to anchor the apparatus at a selected spot on a ground surface. This weighting means 48 is preferably a hollow portion 42' within the bars 42 that contact the ground surface, with either water or sand used as ballast within the hollow portion 42'. A fill tube 50 and a drain tube 52 are used to accommodate weighting and unweighting of the lower bars 42 which are in contact with the ground surface. Clearly, one may use separate hollow portions 42' in the three bars 42 in contact with the ground, or may facilitate a single hollow portion 42' that includes, interactively, all three of the bars at ground level.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A practice goal apparatus comprising: a box-like structure with an open face, the box-like structure providing plural rectangular interior resilient faces, the interior faces set at such angles that a ball entering the box-like structure through the open face is rebounded from the box-like structure in approximately the direction of entry; lengths of a pair of a side faces of the interior faces relative to a length of a rear one of the interior faces forming a ratio of between 1/2 and 3/4; a depth of a top face of the interior faces relative to a height of the rear one of the interior faces forming a ratio of between 1/2 and 3/4 relative to a height of the rear one of the interior faces; the top face and the pair of side faces forming an angle between 100 and 110 angular degrees with the rear face.

2. The apparatus of claim 1 wherein each of the interior faces comprises a frame structure of bars and a netting fastened to the bars by straps to U-shaped bars.

3. The apparatus of claim 2 further including a means for weighting comprising a hollow space within at least one of the bars, and a ballast within the hollow space.

* * * * *